United States Patent [19]

Couture et al.

[11] 4,236,864

[45] Dec. 2, 1980

[54] SAFETY CONTROL SYSTEM FOR THE BOOM OF A CRANE

[76] Inventors: Raymond Couture, 222 Pente du Moulin, Beauceville, Beauce County, Quebec, Canada; Raynald Couture, 307, Gagnon St., Lac Etchemin, Bellechasse County, Quebec, Canada, G0R 1S0

[21] Appl. No.: 959,335

[22] Filed: Nov. 9, 1978

[51] Int. Cl.[3] ..... B66C 23/00; B66F 9/00; E02F 3/00; B66C 13/48

[52] U.S. Cl. ..... 414/699; 212/151; 340/685

[58] Field of Search ..... 414/698, 699; 212/39 R, 212/39 A; 340/685, 686, 688

[56] References Cited

U.S. PATENT DOCUMENTS

| | | | |
|---|---|---|---|
| 3,223,249 | 12/1965 | Cady | 212/39 R |
| 3,228,019 | 1/1966 | Visegila | 340/685 |
| 3,256,998 | 6/1966 | Laharty | 212/39 R |
| 3,265,220 | 8/1966 | Knight | 212/39 R |
| 3,285,430 | 11/1966 | Whitmire | 212/39 R |
| 3,362,022 | 1/1968 | Mork | 340/267 |
| 3,489,293 | 1/1970 | Sallow | 212/3 R |
| 3,505,514 | 4/1970 | Fathauer | 340/685 X |
| 3,534,355 | 10/1970 | Fathaver | 340/522 |
| 3,641,551 | 2/1972 | Sterner | 212/39 X |
| 3,710,368 | 1/1973 | Hamilton | 212/39 R |
| 3,737,888 | 6/1973 | Cheze | 212/39 R X |
| 3,756,423 | 9/1973 | Rathi | 212/39 R |
| 3,848,750 | 11/1974 | Hoge | 212/69 |
| 3,866,200 | 2/1975 | Paredes | 212/2 |
| 3,870,160 | 3/1975 | Hutchings | 212/39 R |

*Primary Examiner*—Stephen G. Kunin

[57] ABSTRACT

A safety control system for a crane adapted to prevent exceeding the uppermost safe elevation of each articulated section of a boom and the safe swinging limits right and left of the boom, which is also adapted to allow the crane operator to preset the safe limits without tools and without leaving the cab of the crane, and wherein the conventional manual controls are disabled to solely allow the required enabling to bring back the boom in the fully operative range. This safety control system preferably includes an electrical elevation sensor for each of two articulated boom sections, an electrical swinging sensor discriminating between left and right safe swinging limits, a warning device indicating the arrival at a limit, a 3-way solenoid valve to regulate the supply of hydraulic fluid to the boom elevation and swinging actuators, and to the conventional manual controls, and relays to control the energization of the 3-way valve, the warning device, and a brake to stop swinging of the boom. The electrical elevation sensors are combined into a unit providing correlation between the elevation limits of the boom sections and also providing for simple remote setting of these elevation limits.

9 Claims, 19 Drawing Figures

SAFETY CONTROL SYSTEM FOR THE BOOM OF A CRANE

This invention relates to safety controls for the boom of a crane, and more particularly, to a safety control system of the type adapted to inactivate the manual controls such as to prevent excessive elevation and swinging of a boom to avoid striking obstacles and the ensuing damages and injuries.

There has anteriorly been proposed control systems which prevent excessive displacements of the boom such as the elevation and the extension of the boom for the purpose of avoiding overloading of the boom and capsizing of the crane upon lifting of a load by a crane. In the present case, such is not our concern which is rather to avoid striking obstacles by either elevation and/or swinging of the boom. This is particularly important in the vicinity of power lines and of buildings.

It is a general object of the present invention to provide a safety control system of the above type which is adapted to prevent exceeding safe elevation as well as swinging of the boom of a crane.

It is more specific object of the present invention to provide a safety control system of the above type which is adapted to allow pre-setting the safe elevation limit and swinging limit directly by the operator in his cab and without recourse to any tool.

It is another object of the present invention to provide a safety control system of the above type wherein the boom elevation and the boom swinging are correlated to effectively de-activate the conventional manual controls for elevation and swinging of the boom before exceeding a safe limit and to solely allow the required activation to return the boom in the fully operative range both elevation and swinging wise.

It is a further object of the present invention to provide a safety control system of the above type which is adapted to individually set and control the uppermost safe elevation of two articulated boom sections such as a heel boom section articulated on a main boom section; and, in particular, it is an object of the invention to provide for remote setting of the individual uppermost safe elevation of each articulated boom section by the operator in the cab on the crane.

The above and other objects and advantages of the present invention will be better understood with reference to the following detailed description of embodiments thereof which are illustrated, by way of example, in the accompanying drawings, in which.

Figure 9:
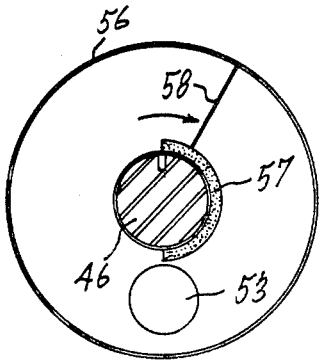
Figure 10:
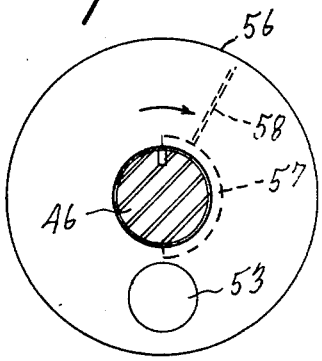
Figure 11:
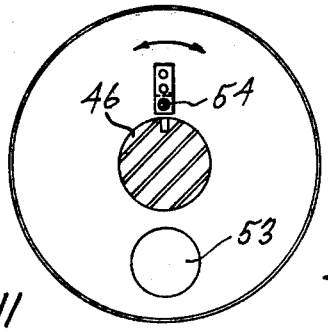
Figure 7:
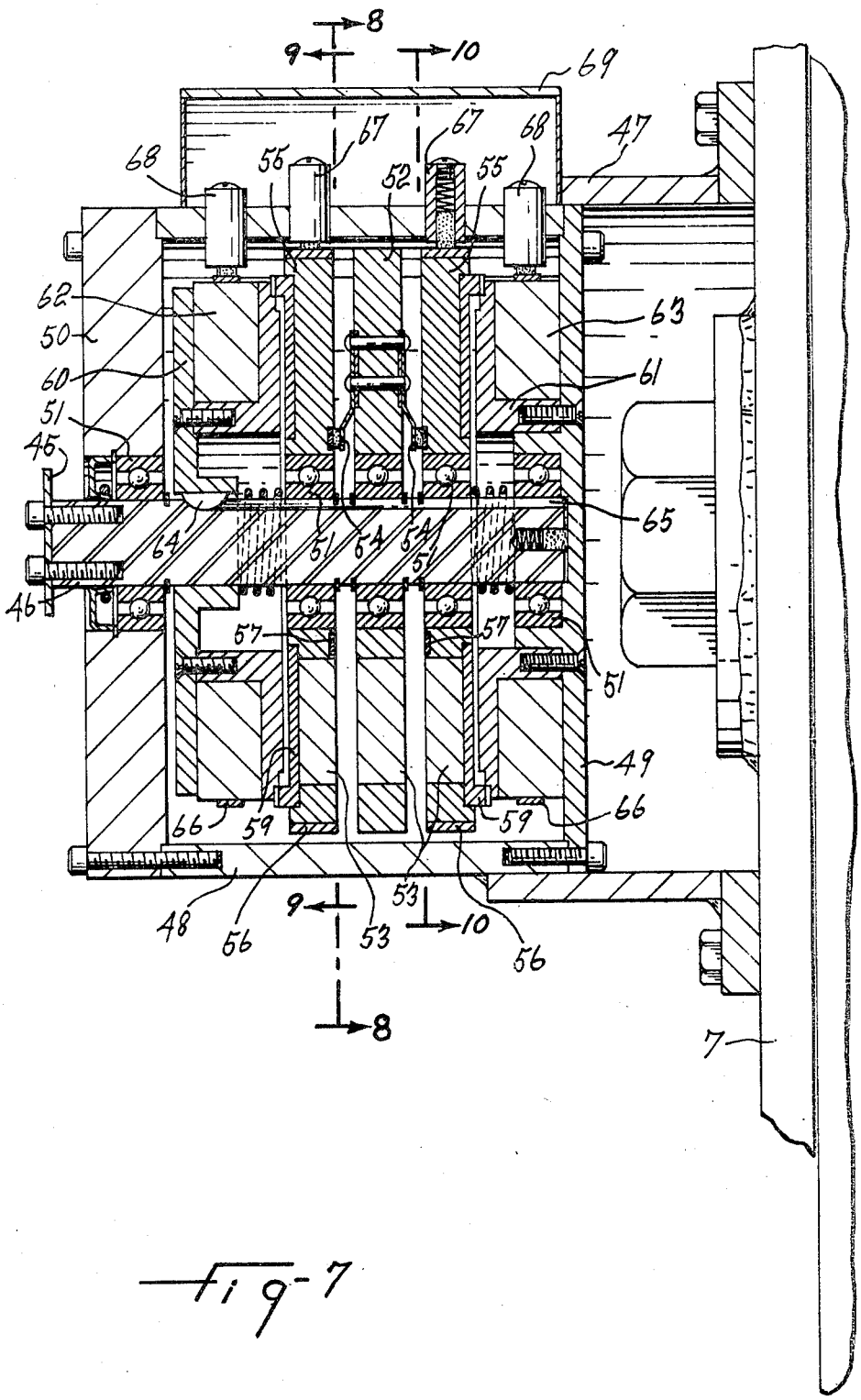
FIG. 7 is a cross-sectional view as seen along line 7—7 in FIG. 6.
Figure 8:
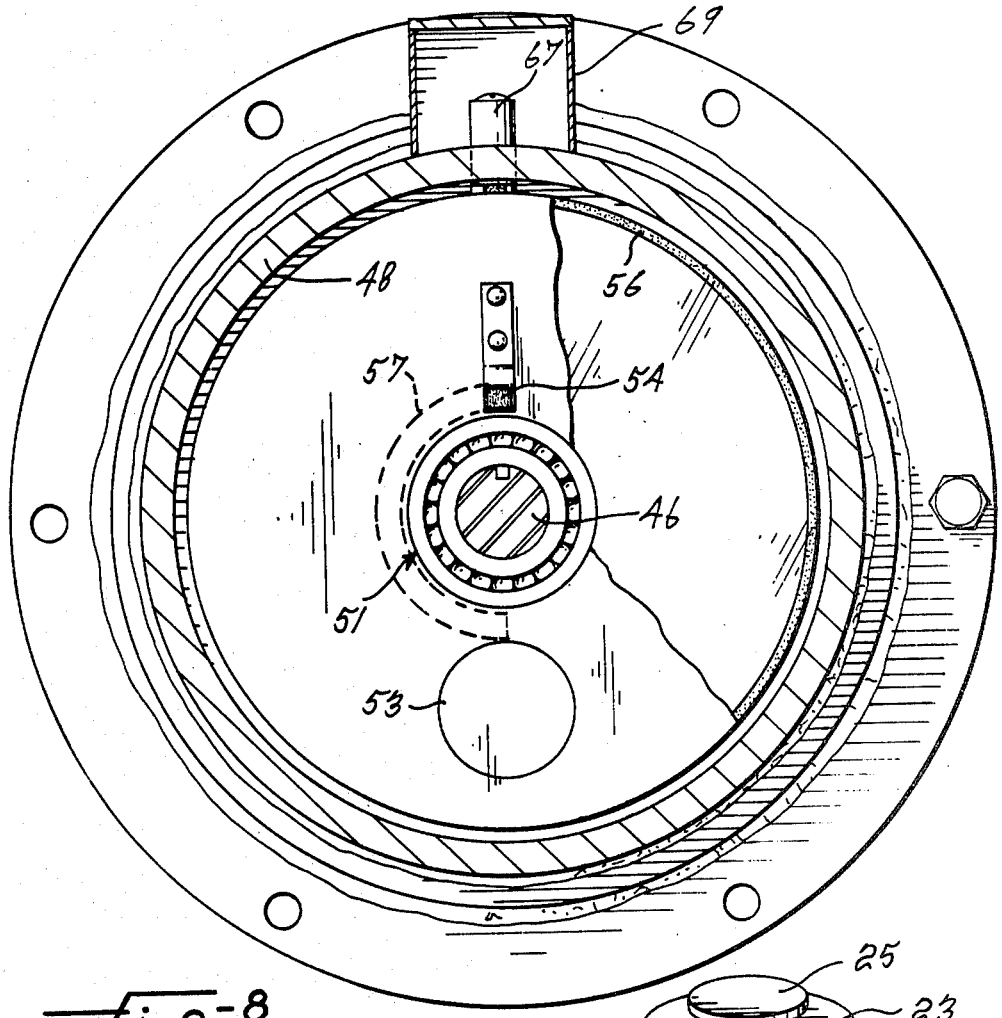
Figure 12:
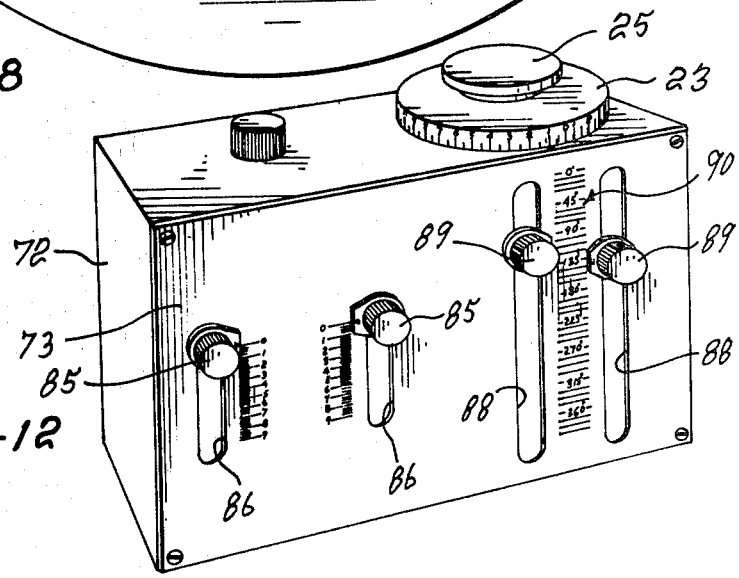
Figures 9, 10, 11, 12, 13, 14, 15:
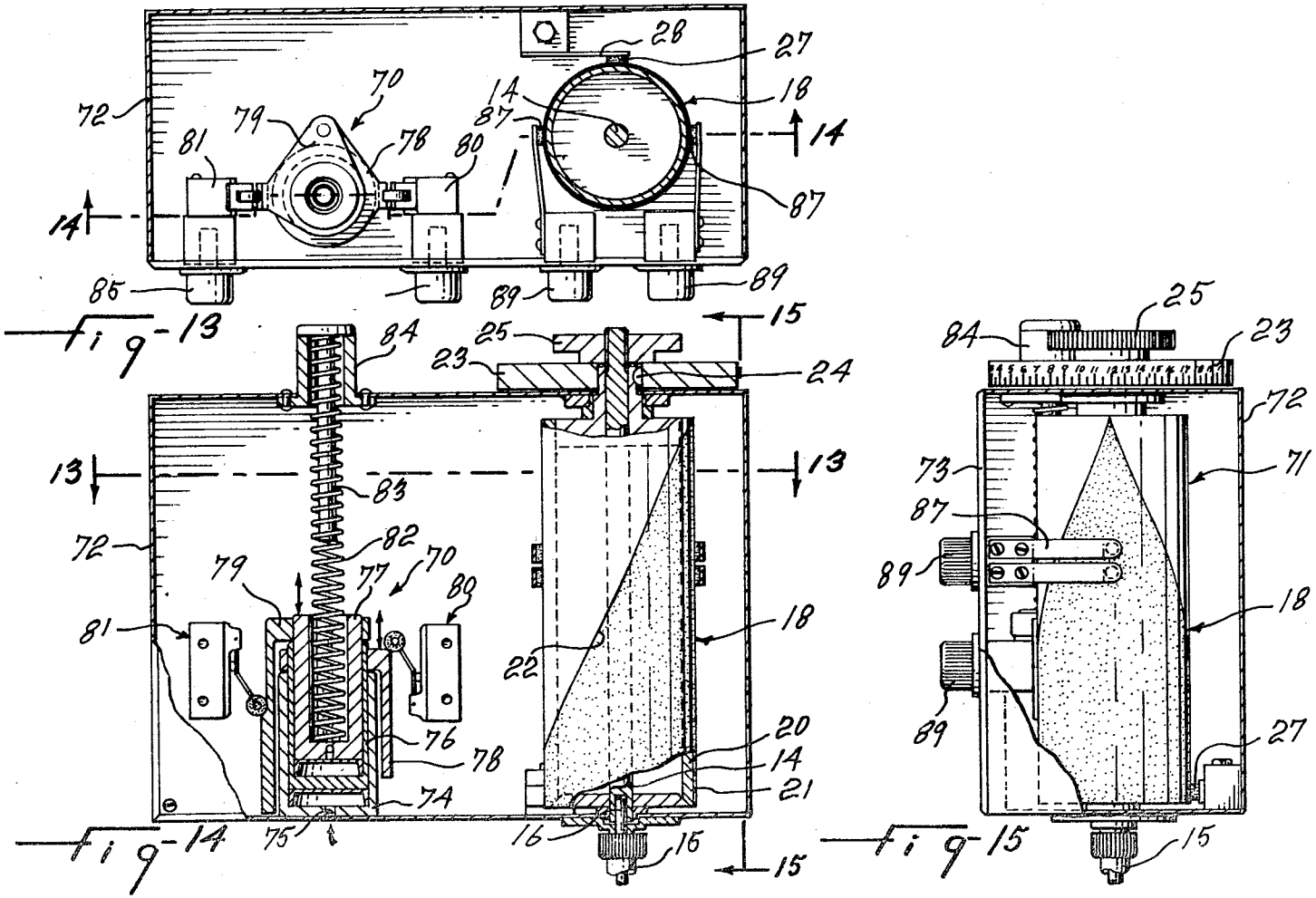
Figure 16:
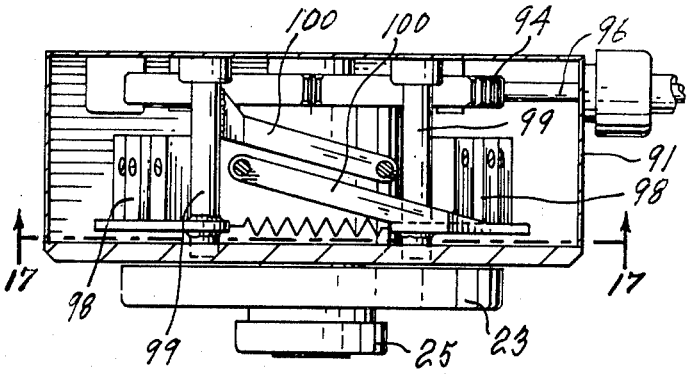
Figure 17:
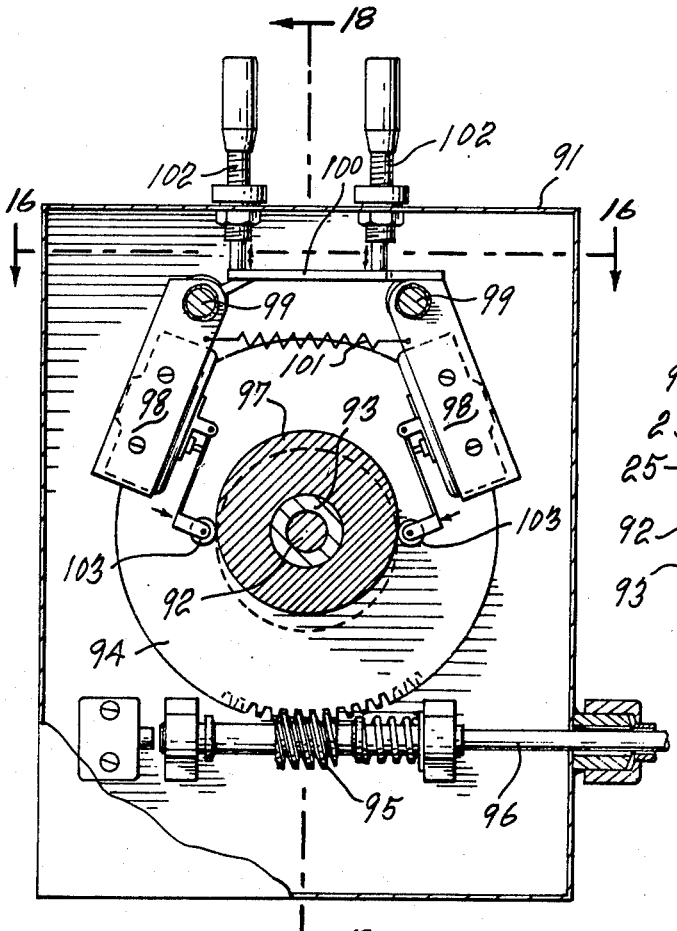
Figure 18:
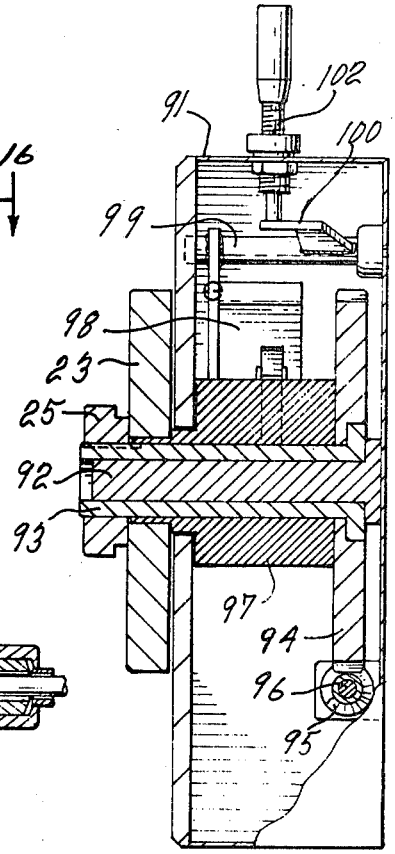
Figure 19:
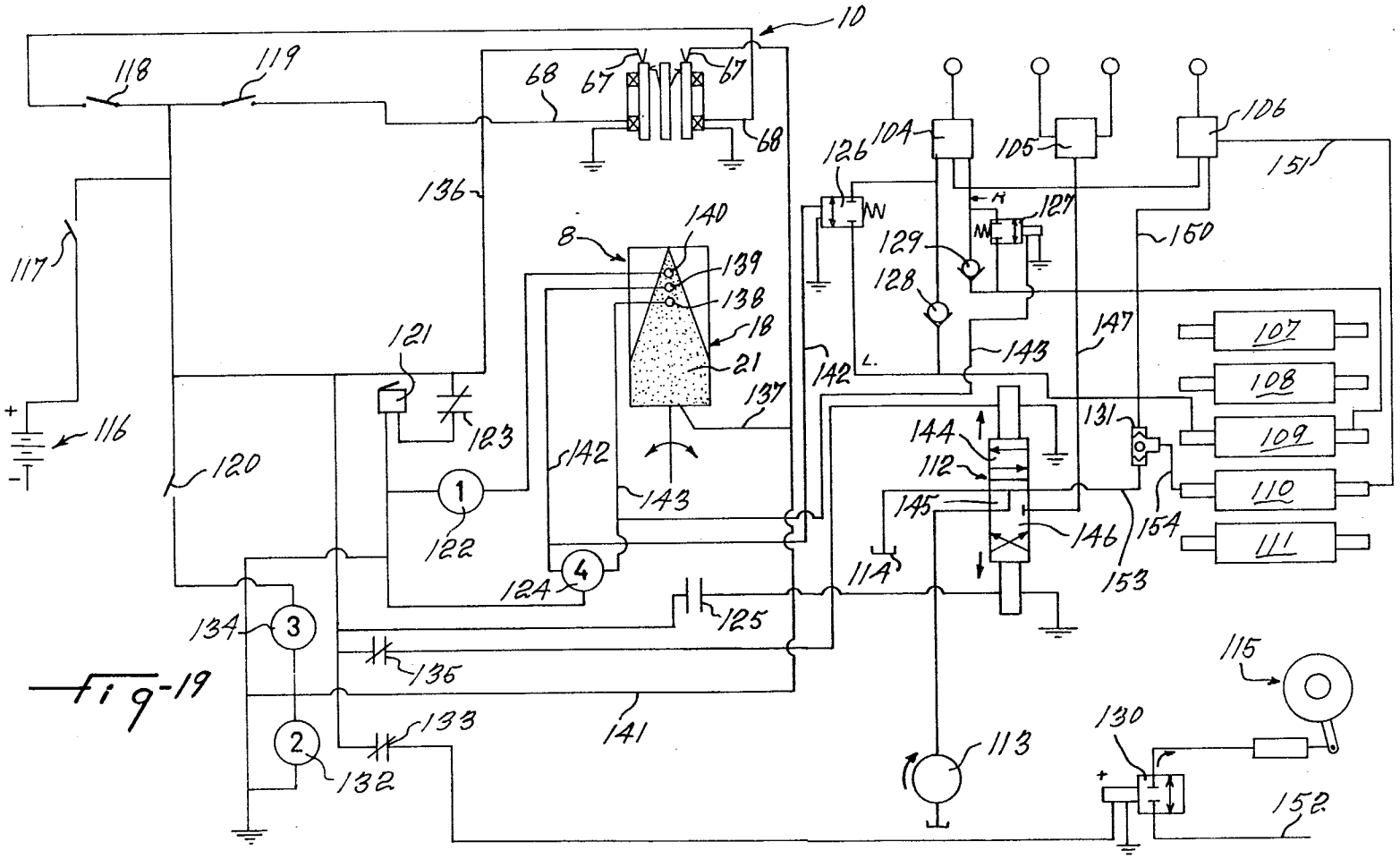

FIGS. 8, 9, and 10 are cross-sectional views as seen along lines 8—8, 9—9 and 10—10 respectively in FIG. 7;

FIG. 11 is a schematic view of FIG. 8 and with no parts broken away;

FIG. 12 is a perspective view of a control box housing a boom elevation sensor unit and a boom swinging sensor unit each according to a second embodiment thereof;

FIG. 13 is an horizontal cross-sectional view through the safety control box of FIG. 12, as seen along line 13—13 in FIG. 14;

FIGS. 14 and 15 are cross-sectional views as seen along line 14—14 and 15—15 in FIGS. 13 and 14 respectively;

FIGS. 16, 17 and 18 are cross-sectional views of a third embodiment of boom swinging sensor unit according to the present invention and as seen along lines 16—16, 17—17 and 18—18 in FIGS. 16, 17 and 18 respectively; and FIG. 19 is a circuit diagram of a safety control system according to a preferred embodiment of the present invention.

Figure 1:
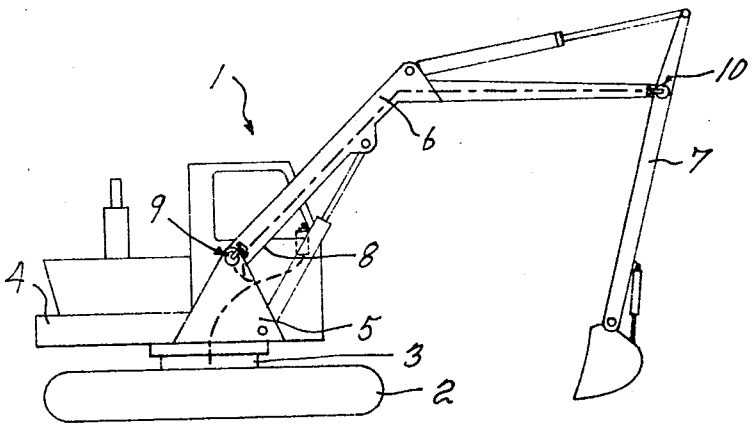
FIG. 1 is a side elevation view of a crane of generally known construction adapted with a safety control system according to the present invention.

The present invention is applicable to a crane of a general type including a boom which swings around and pivots in elevation, such as the crane 1 shown in FIG. 1. This crane 1 comprises an endless track unit 2 carrying a turntable 3 which rotatably mounts the platform 4 for the cab and the brackets 5 supporting the boom. The latter includes a main boom section 6 and a heel boom section 7 which is articulated on the outer end of the main boom section. This crane, according to the present invention, distinctively includes a boom swinging sensor unit 8 operatively mounted in the cab of the crane in front of the operator. The crane also distinctively includes a pair of boom elevation sensor units 9 and 10 secured at the articulations of the main boom section 6 with the brackets 5 and with the heel boom section 7. The boom swinging sensor unit 8 is connected by a flexible cable to the turntable 3 to transmit the angular swinging of the platform 4 and boom 6, 7 as an input thereto.

Figure 3:
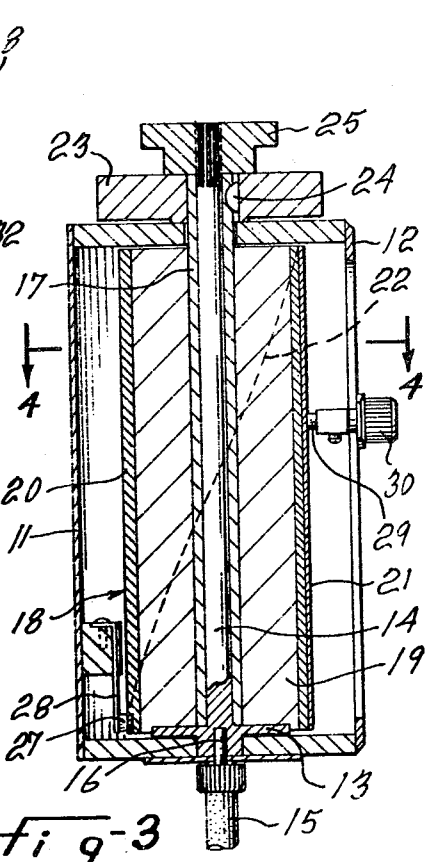
FIG. 3 is a cross-sectional view as seen along line 3—3 in FIG. 2.
Figure 2:
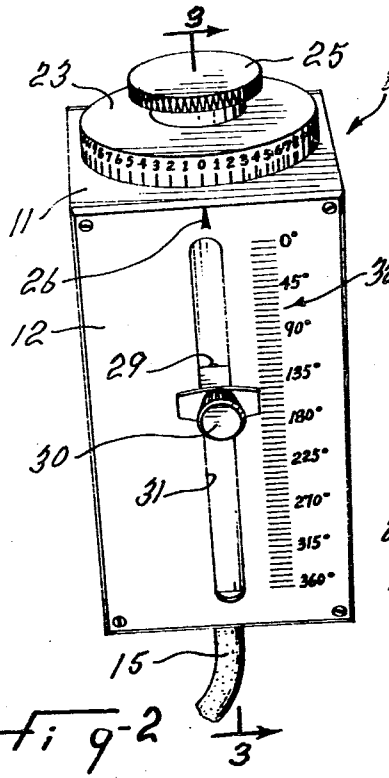
FIG. 2 is a perspective view of a boom swinging sensor unit according to a first embodiment of the present invention.
Figure 4:
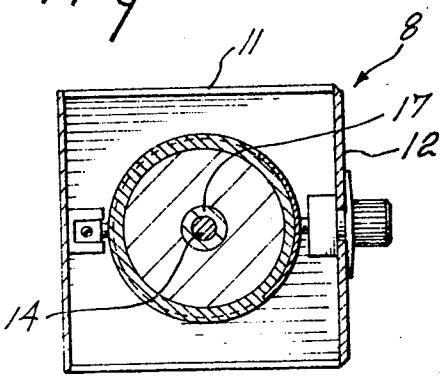
FIG. 4 is a cross-sectional view as seen along line 4—4 in FIG. 3.

The boom swinging sensor unit 8, as shown in the embodiment of FIGS. 2, 3 and 4, includes a housing 11 of rectangular form having a removable front plate 12. Through the bottom of the housing 11 there is rotatably mounted a bearing member 13 having an upward shaft portion 14 upwardly projecting through the top of the housing. A flexible cable assembly 15 is connected to the bearing member 13 by a stud portion 16 engaged frictionally in the bearing member 13. The flexible cable member is connected to the turntable to transmit the angular swinging of the boom to the bearing member 13. A tube 17 is engaged around the upward shaft portion 14 and upwardly projects outward at the top of the housing 11. A drum 18 is engaged over the tube 17 and includes a tubular core 19 and a cylindrical shell 20 of electrically insulating material. The cylindrical external surface of the drum 18 is provided with a coating or facing 21. The latter is of generally triangular shape defining a base extending along the full circumference at the bottom of the drum and a pair of lateral sides 22 upwardly converging toward each other. The coating of facing 21 is of electrically conductive material such as of aluminum or copper.

A dial wheel 23 is fixed to the top of the tube 17 for rotation therewith by a ball 24 and appropriate recesses to allow rotation of dial wheel around the tube 17 and thus, relative to the drum 18. An adjustment knob 25 is secured by a spline on the upper end of the shaft 14 to angularly and manually adjust the drum 18 such that the apex of the conductive coating or facing is centered by alignment with the reference mark 26 on the front 12 of the housing. This setting is done when the boom is aligned in a centered position intermediate between the right hand and left hand swinging limits which are adapted as safe for swinging of the boom and/or crane. When the conductive coating or facing is so set, the dial wheel 23 should have its "0" mark also aligned with the reference mark 26. The boom swinging sensor unit 8 also includes a fixed contact 27 which is spring biased by its supporting bracket 28 into brushing engagement with the base of the triangular conductive facing 21. An adjustable contact 29 is adjustably set by an adjustment knob 30 which rides along the vertical slot 31 in the front cover 12. A dial 32 is marked on the front cover longitudinally of the slot 31 to indicate the safe angular swinging range corresponding to any particular vertical setting of the movable contact 29 and knob 30. It will be readily understood that, due to the covergence of the lateral sides 22, the lower is the contact 29 the longer is the range of swinging of the drum 18 and of the crane and boom before this contact drops off the conductive facing and becomes de-energized. Therefore, as long as the movable contact 29 remains in engagement with the conductive facing 21 between the two lateral sides 22, there is an electrical energization output through the movable contact and as soon as the boom swings past the left or right swinging limit, the movable contact moves outward passed one lateral side 22 and breaks the electric contact with the conductive facing or layer 21 and is electrically de-energized.

Figure 5:
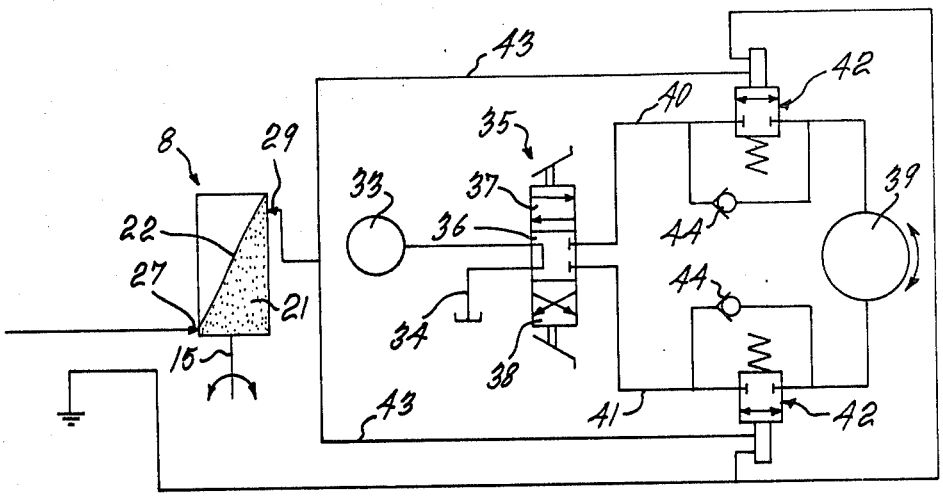
FIG. 5 is a circuit diagram of a safety control system for the boom operation of a crane according to the present invention.

The circuit diagram of FIG. 5 illustrates a system adapted to merely control the safe swinging of the crane and boom. This circuit diagram includes an hydraulic actuator circuit for right or left swinging of the crane and boom and an electrical control circuit connected to the boom swinging sensor unit 8.

The hydraulic actuator circuit of FIG. 5 includes an hydraulic fluid supply pump 33 and a drain 34 connected to a 3-way valve 35. The latter is manually actuated by a conventional manual control, not shown, in the cab of the crane, such that the operator may choose between a fully disabled hydraulic circuit, a right swinging of the crane and boom, and a left swinging of the crane and boom determined by the three stages 36, 37 and 38 respectively of the 3-way valve 35. The downstream or output side of this 3-way valve is connected in closed loop with a rotary hydraulic motor 39 by a pair of hydraulic lines 40 and 41. In each line 40 and 41, there is serially connected a solenoid valve 42.

The electric control circuit includes a pair of conductors 43 connected between the movable contact 29 and the solenoids respectively of the solenoid valves 42. The latter are arranged to close the hydraulic circuit loop through the rotary hydraulic motor when the movable contact 29 is energized; that is, in engagement with the conductive facing 21.

Therefore, when the manual control is released by the crane operator, the 3-way valve is biased to its deactivating stage 36 and no powering hydraulic fluid is pumped either way in the hydraulic loop 39, 40, 41. The operator may select the swinging direction by operating the manual control to shift the valve 35 either way. If he places valve stage 37 in communication with the pump, the flow goes clockwise in the hydraulic lines 40, 41 and the motor 39 producing swinging of the boom in the right hand direction. The stage 38 produces swinging in the left hand direction. It must be noted that the solenoid of both valves 42 are simultaneously energized or de-energized by the swinging sensor unit. When both valves 42 are so de-energized, there is no flow of hydraulic fluid possible through these valves and the check valves 44 are provided to allow some limited flow in opposite direction to swing the boom back to the safe swinging range and this re-energizes the movable contact 29 and the solenoid valves 42.

Figure 6:
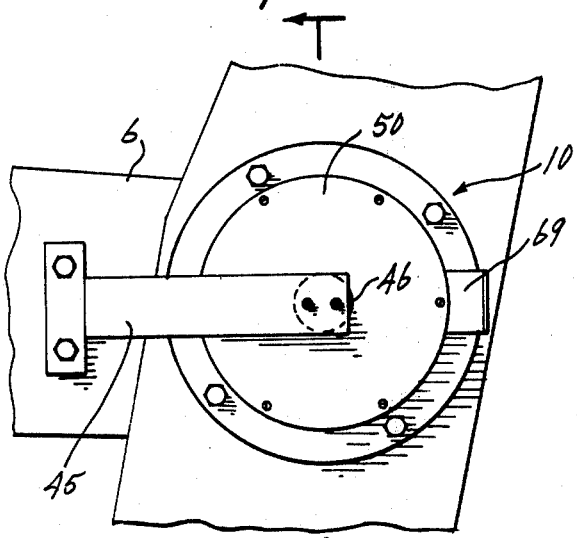
FIG. 6 is a side view of a boom elevation sensor unit according to a first embodiment of the present invention and operatively secured at the articulation between the main boom section and the heel boom section of the boom shown in FIG. 1.

The boom elevation sensor unit 10 of FIGS. 6 to 11 inclusive is adapted to be connected to the boom sections 6 and 7 at the articulation between them, as shown in FIGS. 1 and 6. This boom elevation sensor unit 10 includes an L-shaped bracket 45 which is rigidly fixed at one end to the main boom section 6 and has an outer portion to which is fixedly secured a spindle 46. The latter is positioned with its axis in alignment with the pivot axis between the two boom sections 6 and 7. The bracket 45 and spindle 46 are thus bodily pivotable with the main boom section 6 and thus undergo spatial rotation about this common axis. The boom elevation sensor unit 10 also includes a cylindrical member 47 forming a bracket secured endwise to the heel boom section 7 and co-axially with the spindle 46 to bodily pivot with the heel boom section 7 and thus undergo spatial rotation about the mentioned common axis. To the cylindrical bracket member 47, there is co-axially secured a cylindrical housing including a tubular portion 48 and removable end covers 49 and 50. A pair of ball bearings 51 rotatively mount the spindle 46 in the housing 48, 49, 50.

A common contact disk 52 is rotatably mounted freely on the spindle 46 by another ball bearing 51. The disk 52 embodies a counterweight 53 to maintain the disk in a predetermined angular spatial direction to provide an angular reference. A pair of contacts 54 projecting from the opposite lateral faces respectively of the common contact disk 52 and electrically connected by the resilient metal blades and the rivets securing the blades to the disk.

The boom elevation sensor unit 10 includes a pair of electrical elevation sensors on the opposite sides respectively of the common disk. Each electrical elevation sensor includes a lateral contact disk 55 positioned adjacent a corresponding lateral face of the common contact disk and mounted for free rotation around the spindle 46 by another ball bearing 51. Each lateral contact disk 55 also has a counterweight 53 embedded therein to angularly hold the same in a predetermined angular spatial position. Each lateral disk 55 is provided with a slip ring 56 on the circumference thereof, a half-ring contact 57 secured coaxially of the same disk and projecting from the latter in registry with the corresponding contact 54 to axially and slidably engage the latter. Each lateral contact disk is also provided with a conductor 58 electrically connecting the slip ring 56 to the corresponding half-ring contact 57. A ring gear 59 is secured against the opposite side of each lateral contact disk 55 relative to the corresponding half-ring contact 57.

Each electrical elevation sensor also includes an electromagnet ring device or electric latch means formed of an annular body 60 or 61 housing an annular electromagnet 62 or 63. The body 60 is releasably keyed to the spindle 46 by a ball 64 engaged in a keyway 65 of the spindle. The body 61 is screwed to the cover 49 of the enclosing housing. Thus, the electromagnet 62 is bodily rotatable with the spindle 46 while the electromagnet 63 is bodily rotatable with the housing 48, 49, 50. Each body 60, 61 is formed with a ring gear adapted to axially register with the ring gear 59 of the corresponding lateral contact disk 55. Each electromagnet 62, 63 is circumferentially engaged by a slip ring 66. Each slip ring 56 is engaged by a brush contact 67 and each slip ring 66 is engaged by a brush contact 68. The brush contacts 67 and 68 are accessible under a removable cover 69.

As may be seen in FIG. 7, the contact disks 55, 52 and 55 are electrically connected in series through the conductive elements 67, 56, 58, 57, 54, 54, 57, 58, 56 and 67. Therefore, when either of the two contacts 54 disengages its corresponding half-ring contact 57, the electric circuit is broken and this interrupts the energizing output through these elements.

The safe elevation limit for any of the two boom sections is set by elevation of the boom sections to this safe elevation limit and then electrically setting this limit by energization of the corresponding electromagnet. This has for effect to lock the corresponding lateral contact disk 55 so that it thereafter rotates or pivots bodily with the corresponding boom section. This locking is magnetically produced by mashing the corresponding ring gears. It must be noted that when in this safe elevation limit, the contact 54 engages the upper end of the corresponding half-ring contact 57, when the corresponding boom section is lowered, it displaces the half-ring contact such that the contact 54 moves inwardly away from this upper end; if, on the contrary, the same boom section is elevated further, the half-ring contact 57 is displaced such that the corresponding contact 54 slides off this upper end and the electrical circuit is broken indicating that the safe elevation limit is exceeded.

The aforedescribed boom elevation sensor unit 10 is put into use in the safe control circuit of FIG. 19, but it could be used in other comparable circuits as well to prevent further elevation of the boom while preferably also allowing solely the lowering of the boom.

In FIGS. 12 to 15 inclusive, there is shown a control box including a boom elevation sensor unit 70 and a boom swinging sensor unit 71 adapted to be used in a safe control system to stop the boom before it strikes any obstacle either upon swinging or upon elevation thereof.

The control box includes a housing 72 provided with a removable front cover 73. The boom elevation sensor unit 70 is adapted to independently sense the elevation of each of two boom sections articulated to each other. This boom elevation sensor unit has a hydraulic cylinder body 74 having an open end and a hydraulic fluid port 75 in the other end. A pair of hydraulic pistons 76, 77 are slidable in the hydraulic cylinder body 74, one within the other. Cam members 78 and 79 are secured to the pistons 76 and 77 respectively to be linearly displaceable therewith. A pair of cam actuable switches 80, 81 are positioned adjacent the cam members 78 and 79 respectively to be actuated by the latter. A spring 82 downwardly biases the hydraulic pistons 76, 77 toward a switch opening position in which the switches 80 and 81 are not closed by the cam members 78 and 79 respectively. The spring 82 is engaged around a guide pin 83 in a retaining cap 84 which upwardly projects from the top of the housing 72.

Each piston 76, 77 is actuated by hydraulic fluid fed through the port 75 in relation with the angular elevation of one of the main boom section 6 and heel boom section 7. This may be done by replacing the elements 9 and 10 by a cam and hydraulic cylinder assembly (not shown) arranged such that pivoting of the boom section causes the piston of the hydraulic cylinder to be proportionally displaced by the cam and to expel hydraulic fluid to the port 75. The switches 80, 81 are connected to a pair of knobs 85 respectively which slide in slots 86 and are set at any height along the slots by tightening thereof to upwardly adjust the switches and thus adjust the operation thereof at a more or less high elevation of the corresponding boom sections.

The boom swinging sensor unit 71 is of substantially the same construction and operation as the boom swinging sensor unit 8, also including the same elements 14, 15, 16, 18, 20, 21, 22, 23, 24, 25, 27, and 28. In this case, the sensor unit 71 includes two movable contacts 87, each adjustable along a corresponding slot 88 by a corresponding tightening knob 89. A graduated scale 90 is marked on the front cover 73 between the pair of slots 88 to indicate the left and right boom swinging angle corresponding to the setting of the knob.

The boom swinging sensor unit of FIGS. 16, 17 and 18 includes a housing 91 in which is fixedly mounted a pin 92. A tubular shaft 93 is rotatably engaged on the pin 92. A gear 94 is fixed on the inner end of the tubular shaft 93 in meshing engagement with a worm gear 95 secured on an input drive shaft 96. The shaft 96 is driven like the cable 15 by swinging of the boom.

A cam 97 of predetermined profile is secured on the tubular shaft 93 for rotation therewith. On the outer end of the cam 97, there is mounted a dial wheel 23 for rotation therewith. An adjustment knob 25 is secured by splines on the outer end of the tubular shaft 93 to preset the latter and the cam 97 with the boom in centered swinging position. A pair of electric switches 98 are secured each on one arm 99 of a lever having another arm 100 biased by a spring 101 against a micrometer screw 102. The latter serves to pivotally adjust the electric switch such that the cam follower roller 103 thereof is moved either farther or closer relative to the cam 97 such that more or less swinging of the boom will occur before engagement of the roller to actuate the corresponding switch. Thus, the switches 98 are adapted to sense swinging of the boom to either a left or a right safe swinging limit.

The circuit diagram of FIG. 19 illustrates a safety control system for the boom of a crane wherein, as in FIG. 1, the boom includes a main boom section 6 and a heel boom section 7.

This safety control system includes the boom elevation sensor unit 70, the boom swinging sensor unit 8, three conventional 4-way manual controls 104, 105, and 106, a series of five 2-way hydraulic actuators 107-111 for the bucket, track, swing, main boom and heel boom respectively, a 3-way solenoid valve 112, an hydraulic fluid supply pump 113, a drain 114, an hydraulic brake 115, a battery 116, manual switches 117, 118, 119 and 120, a buzzer 121, a buzzer actuating relay 122 and energizing contacts 123, a relay 124 and its contacts 125 to fully disable the manual controls 104, 105 and 106, a pair of solenoid valves 126,127 and check valves 128, 129 to control swinging of the boom, a solenoid valve 130 to control the hydraulic brake 115, a changeover check valve 131, a brake controlling relay 132 and contacts 133 thereof, a manually switched on relay 134 and contacts 135 to merely enable the lowering of the boom, and all the necessary electrical and hydraulic connections as hereinafter described in relation with the detailed operation of this safety control system.

As aforementioned, when the main and heel boom sections 6 and 7 are within the safe elevation range, there is electrical connection between the brush contacts 67, 68 through the contacts 54 of the common disk 52. When the main switch 117 is closed, electric power is supplied by a conductor 136 to energize the brush contacts 67, 68, the conductor 137, the contact 27, the triangular conductive facing 21 and the contacts 138, 139 and 140 engaging the facing 21. The buzzer control relay 122 is then energized to open the normally closed contacts 123. The buzzer 121 is thus de-energized and turns silent. This indicates that the boom is well in the safe swinging range and in the safe elevation range. A conductor 141 then energizes the brake control relay 132 to open the contacts 133. The solenoid valve 130 is thus de-energized and the brake 115 is released. The relay 124 includes two energizable coils, not shown, which are then both simultaneously energized by the conductors 142, 143 connected to the energized contacts 138, 139 respectively. The relay 124 is thus caused to close the contacts 125 which energize the 3-way solenoid valve 112 to draw the stage 144 thereof in communication with the pump 113 and the drain 114. The hydraulic line 147 then enables the manual controls 104, 105 and 106 which control all operations of the crane and boom. For instance, the manual control 104 in one mode controls the heel boom and in another controls the right and the left swinging; the manual control 105 controls the tracks of the crane; and the manual control 106 controls the bucket and the main boom section. For the sake of clarity, the hydraulic lines connecting the bucket actuator 107, the track actuator 108, and the heel boom actuator 111 to the corresponding manual controls are not shown since they do not form part of the present invention. The energized conductors 142 and 143 also energize the solenoid valves 126 and 127 which thus open for hydraulic flow therethrough. The operation of the manual control 104 may then cause either right hand or left hand swinging by appropriate direction of flow in the hydraulic lines 148 and 149 forming a closed loop with the swing actuator 109 and the valves 126, 127. The operator may also either elevate or lower the main boom section 6 through the hydraulic lines 150 and 151 connected to the changeover check valve 131 and the main boom actuator 110.

In that fully enabled and operational position, the manual switch 120 is open and the relay 134 is de-energized.

When either of the main boom section and heel boom section exceeds the safe elevation limit, the corresponding contact 54 slides off the corresponding half-ring contact 57 and the contact is broken with the conductors 137 and 141, thus becoming de-energized. This causes de-energization of the conductive facing 21, contacts 138, 139, 140 and the relays 122, 124 and 132. The contacts 123 then close to sound the buzzer 121 to indicate the hazard; the contacts 125 then open to release the valve 112 which automatically moves to register the stage 145 with the pump 113 and the drain 114; and the contacts 133 close to energize the solenoid valve 130, and automatically place the hydraulic brake 115 in circuit with an hydraulic fluid line 152 which is under pressure to apply the brake. Since the two conductors 142 and 143 are de-energized, the solenoid valves 126 and 127 are also de-energized and any hydraulic flow is interrupted to swing the boom. As aforementioned, in such situation the stage 145 of the 3-way valve 112 is positioned as shown in FIG. 19 with an hydraulic line 153 solely connecting this valve to the changeover check valve 131. Thus, the pump pressure 113 operates the changeover check valve 131 to supply hydraulic fluid through the line 154 to the main boom actuator 110 such as to automatically lower the boom and bring the system to the full enabled condition which was aforedescribed.

If instead the safe swinging limit left or right is exceeded, the conductors 137 and 141 remain energized and the brake 115 remains off. However, one of the contacts 138, 139 is outward of the conductive facing 21, the corresponding conductor 142 or 143 is de-energized, and only one of the valves 126 and 127 is energized and the operator can then swing the boom only in the opposite direction to come back in the safe swinging range. When one of the conductors 142, 143 is de-energized, the other conductor is sufficient to keep the relay 124 energized and the 3-way valve 112 in fully enabling position.

It must be noted that the contact 140, being higher than the contacts 138 and 139, slides off the conductive facing 21 before either of these other two contacts. This causes sounding of the buzzer 121 as a pre-warning before either the right or the left safe swinging limit is exceeded. This enables the operator to avoid ever reaching either of these swinging limits if he listens to the warning given by the buzzer.

As aforementioned with reference to FIGS. 6 to 11 inclusive, the safe elevation limit of each boom section is set by electrically energizing the electromagnets 62 and 63 when the boom sections are elevated at the safe elevation limit. Selective and separate energization of the electromagnets 62 and 63 is produced by closing the switches 118 and 119 which remain closed during operation of the crane and the boom.

What we claim is:

1. A safety control system for the boom of a crane, said system comprising a boom elevation actuator and a boom swinging actuator connected to the boom and operatively varying the elevation and the swing angle of the boom respectively, manual controls connected to said boom elevation and boom swinging actuators, a 3-way solenoid valve operatively connecting said actuators to an hydraulic fluid supply and to said manual controls and selectively displaceable between an enabling position allowing operation of said actuators by said manual controls, a disabling position allowing no operation of said actuators by said manual controls, and a partial enabling position allowing sole lowering of the boom, a boom elevation sensor unit sand a boom swinging sensor unit operatively connected to the boom and each producing an energizing output in response to safe boom elevational movement and to safe swinging of the boom respectively, a first relay connected to said sensor units and to said 3-way solenoid valve and operating the latter to the all enabling position thereof in response to simultaneous production of said energizing outputs by said sensor units, a second relay connected to said 3-way solenoid valve and selectively operating the latter to the partial, boom lowering, enabling position thereof to selectively lower the boom concurrently with all disabling of said manual controls, the manual control means connected to said second relay and selectively energizing the latter solely for boom lowering upon displacement of said 3-way valve to said partial enabling position.

2. A safety control system as defined in claim 1, further including a solenoid actuated brake connected to said boom and selectively braking the swinging movement thereof, and a third relay connected to said boom elevation sensor unit and to said solenoid actuated brake, serially with the boom elevation sensor unit and the solenoid of said brake whereby the cancellation of the energizing output of the boom elevation sensor unit de-energizes said third relay and allows actuation of said brake.

3. A safety control system as defined in claim 2, wherein said sensor units are serially connected with the output of one energizing the other, and said third relay has an input side connected to both said boom elevation sensor unit and to the manually energizable second relay allowing selective de-energization of the said third relay and operation of said brake by either of the boom elevation sensor unit and the manual control means energizing said second relay.

4. A safety control system as defined in claim 3, further including a pair of hydraulic fluid lines connecting one of said manual controls to said boom swinging actuator and arranged for selective right and left swinging of the boom, a solenoid valve serially connected in each of said fluid lines, a check valve bypassing each of the solenoid valves in direction toward said one manual control, and said boom swinging sensor unit including a left hand and a right hand contacts operatively sensing the left swinging limit and the right swinging limit respectively of the boom, connected to said solenoid valves respectively and arranged to allow swinging of the boom in opposite direction upon arrival of the boom at the swinging limit in the other direction.

5. A safety control system as defined in claim 4, wherein said first relay includes a pair of separate energizing coils connected to said right hand and left hand contacts respectively and arranged to individually and concurrently operate the relay and said 3-way solenoid valve.

6. A safety control system as defined in claim 4, further including said boom swinging sensor unit having a third contact arranged for de-energization shortly before arrival to either of the two opposite boom swinging limits, a buzzer, a buzzer controlling relay serially connected with said sensor units in parallel with said first relay and operatively allowing closed circuiting of said buzzer upon de-energization shortly before arrival to either of the two opposite boom swinging limits.

7. A safety control system as defined in claim 4, wherein said boom includes a main boom section and a heel boom section articulated in elevation one to the other and relative to the crane, said boom elevation sensor unit includes an electrical elevation sensor for the main boom section, and an electrical elevation sensor the heel boom serially connected and cooperatively producing said energizing elevation output, each of said electrical elevation sensors is selectively settable at a predetermined elevation angle.

8. A safety control system as defined in claim 7, wherein each of said electrical elevation sensor includes a first and a second contact devices arranged for free rotation about an axis extending transversely to the vertical plane of elevation of the boom and having each a counterweight to angularly maintain said contact devices spatially fixed, and having each an electrical contact, one in brushing engagement with the other, and arranged to cooperatively produce a contact braking angular elevation limit, each of said electrical elevation sensors including an electrical latch means selectively and operatively locking the first contact device for pivotal displacement bodily with one of said boom sections, and a manual switch is connected to said electrical latch means to operatively and selectively produce said locking upon elevation of said one boom section to the maximum allowable elevation.

9. A safety control system as defined in claim 8, wherein said boom elevation sensor unit includes a first and a second brackets operatively secured to said main boom section and heel boom section and pivotable bodily with said boom sections respectively about said axis constituting a common axis with the pivot axis between the boom sections, the second contact devices for both electrical elevation sensors include a common contact disk freely rotatable about said common axis, a counterweight secured to said disk, and a pair of electrical contacts projecting from the opposite lateral faces respectively of said disk and electrically connected to each other, the first contact device of each electrical elevation sensor includes a lateral contact disk freely rotatable about said common axis, a counterweight, a contact ring secured coaxially to said disk, a breaking contact secured on one lateral face of the corresponding contact disk in axial registry with one of the electrical contacts of the common disk and electrically connected to the corresponding contact ring, said boom elevation sensor unit includes a spring axially biasing each of said lateral contact disk for engagement of each breaking contact with one corresponding electrical contact of the common disk, each of said electrical latch means includes an electromagnet unit rotatable with the corresponding boom section, axially displaceable into latching engagement with the corresponding lateral contact disk for bodily rotation therewith, and said manual switch for each electrical latch means is connected to said electromagnet unit to selectively energize the latter and latch the corresponding lateral contact disk for bodily rotation with the corresponding boom section.

* * * * *